US009399563B2

(12) United States Patent
Vlad

(10) Patent No.: US 9,399,563 B2
(45) Date of Patent: Jul. 26, 2016

(54) PEOPLE MOVER

(71) Applicant: KONE CORPORATION, Helsinki (FI)

(72) Inventor: Rene Vlad, Gevelsberg (DE)

(73) Assignee: KONE CORPORATION, Helsinki (FI)

( * ) Notice: Subject to any disclaimer, the term of this patent is extended or adjusted under 35 U.S.C. 154(b) by 0 days.

(21) Appl. No.: 14/736,027

(22) Filed: Jun. 10, 2015

(65) Prior Publication Data

US 2015/0274490 A1 Oct. 1, 2015

Related U.S. Application Data

(63) Continuation of application No. PCT/EP2013/051960, filed on Jan. 31, 2013.

(51) Int. Cl.

| | |
|---|---|
| ***B66B 29/00*** | (2006.01) |
| ***B66B 21/02*** | (2006.01) |
| ***B66B 21/10*** | (2006.01) |
| ***B66B 23/14*** | (2006.01) |
| ***B66B 27/00*** | (2006.01) |

(52) U.S. Cl.

CPC ..... *B66B 29/00* (2013.01); *B66B 21/02* (2013.01); *B66B 21/10* (2013.01); *B66B 23/14* (2013.01); *B66B 29/005* (2013.01)

(58) Field of Classification Search

None

See application file for complete search history.

(56) References Cited

U.S. PATENT DOCUMENTS 5,842,554 A * 12/1998 Stoxen ..... B66B 25/00 198/322

7,002,462 B2 * 2/2006 Welch ..... B66B 27/00 340/286.02

FOREIGN PATENT DOCUMENTS

DE 202007003913 U1 5/2007

* cited by examiner

*Primary Examiner* — Kavel Singh

(74) *Attorney, Agent, or Firm* — Birch, Stewart, Kolasch & Birch, LLP

(57) ABSTRACT

A people mover including steps or pallets supported via wheels on support rails, which steps or pallets are connected to at least one drive element which is driven by a drive machine, whereby the steps or pallets are running in an upper conveyor track of the people mover in a conveying direction and in a lower return track in the opposite return direction. In the people mover, a support structure is provided in a short distance below the steps or pallets running in the conveyor track, whereby in connection with the support structure at least one sensor is provided which is configured to output a load signal dependent on a load applied to the support structure. This people mover offers an improved safety to passengers.

20 Claims, 4 Drawing Sheets

18

Figure 1:
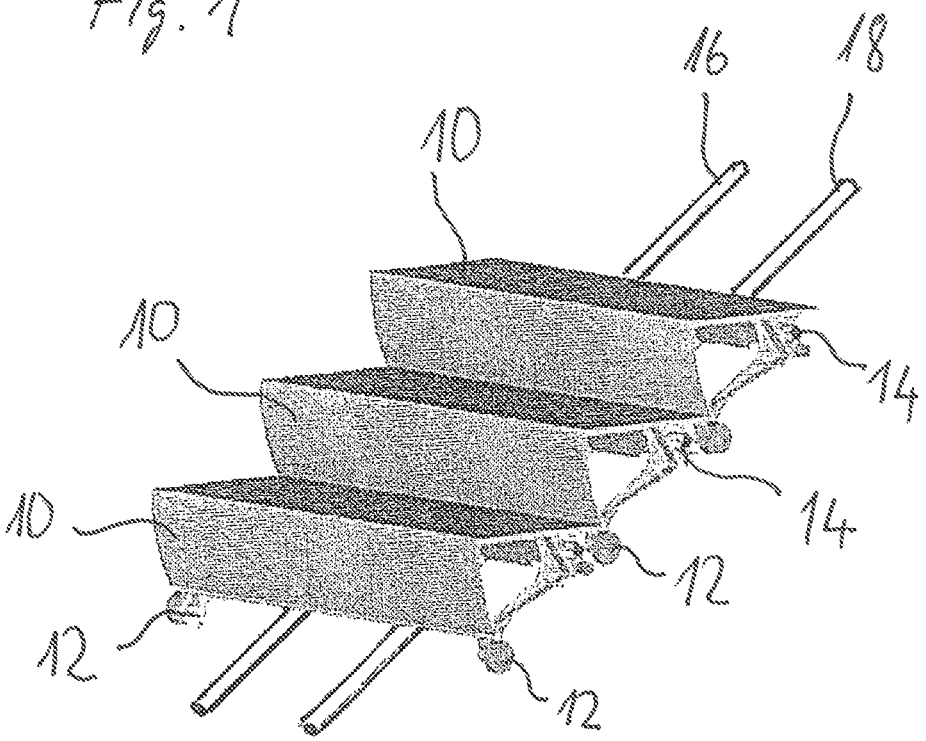

20
22
26
26
16
24
26
22
26

PEOPLE MOVER

CROSS REFERENCE TO RELATED APPLICATIONS

This application is a Continuation of PCT International Application No. PCT/EP2013/051960 filed on Jan. 31, 2013, which is hereby expressly incorporated by reference into the present application.

The present invention relates to a people mover comprising steps or pallets which are supported via wheels on support rails. Well known types of a people mover are escalators and travelators. The steps or pallets of the people mover are connected to at least one drive element which is normally an endless chain. Usually, the steps or pallets are connected to two parallel drive elements located on both sides of the steps or pallets. The drive element is driven by a drive machine which is usually located in vicinity of one end of the people mover. The steps or pallets are running in an upper conveyor track where the people are standing on the steps or pallets and are moved from the entrance end to the exit end of the people mover. In a people mover with two directions, the conveying direction might change. Under the conveyor track is a return track where the steps or pallets are returned from the exit end back to the entrance end. This kind of a people mover is a standard design for escalators and travelators. A problem might result when a step or pallet gets damaged or breaks. This could cause severe harm to the passengers using the people mover.

It is therefore object of the invention to provide the people mover with a higher safety level for the passengers.

According to the invention, this object is solved in a people mover of the above-mentioned type by providing a support structure in a short distance below the steps or pallets running in the conveyor track. This support structure is provided to support broken pallets or steps and keep them from falling into the people mover structure. Therefore, even if a pallet or step of the people mover breaks, it is still supported by the support structure running below the steps or pallets in the area of the conveyor track. The short distance is chosen as small as not to interfere with the steps or pallets when they are running during normal operation but the short distance should not be that high that a pallet or step crushing down on the support structure moves so much so that people standing on that step or pallet might fall. An distance of 1 to 30 mm, better 1 to 15 mm or most preferably 1 to 10 mm has been found appropriate for this purpose. This distance ensures that the step or pallet moves down in case of a breakage only a very little amount but not that much that people standing on said step or pallet might fall. By keeping a minimum distance of 1 mm it is further ensured that the lower edges of the moving steps or pallets in the conveyor track do not interfere with the support structure during their normal operation.

This support structure may be any scaffold or grating or even rods running parallel to the moving direction whereby in case of rods at least two spaced apart rods should be provided. The support structure is preferably mounted on a fixed surrounding, e.g. on the building where the people mover is installed or most preferably on the frame of the people mover.

In connection with the support structure at least one sensing means is provided which is configured to output a load signal dependent on a load applied to the support structure. This sensing means can be any kind of optical, electric or mechanic sensing device e.g. a micro switch, a piezoelectric means, any load weighing device or even optical means. The sensing means must be able to detect whether a load applied by a broken step or pallet is impacted on the support structure.

The load signal can either be forwarded to a remote monitoring site which immediately takes the necessary actions and/or it can be forwarded to the control unit of the people mover as to immediately stop the people mover. Via this measure, the entrance of the broken step or pallet into the step plate area at the ends of the people mover can effectively be avoided. Accordingly, the passenger safety is essentially improved with respect to the known solutions and additionally no harm in the structure of the people mover is caused by the broken step or pallet. This early recognition of a broken step or pallet reduces the danger of further damage in the structure of the people mover.

Accordingly, preferably the people mover comprises a control unit which is connected to the signal output of the sensing means. Via this connection, the control unit is able to immediately stop the people mover if the load signal indicates a broken step or pallet. This recognition can be made by simple comparison with reference values. This connection can also be used by the control unit to detect any changes in the load signal which could be forwarded to a remote maintenance unit to initiate a maintenance or service.

Preferably, the people mover is a travelator or escalator for which the inventive technology is adapted as these kinds of people movers are in line with the base structure of the invention.

Preferably, the support structure comprises spaced apart rods extending in moving direction of the pallets. This kind of support structure is on one hand easily to provide and to install and does on the other hand not interfere essentially with other structures of the people mover. Furthermore, this structure allows the sliding of a broken step or pallet on the rods for the distance the people mover needs to stop.

The support structure is located below the steps or pallets in the conveyor track and most preferably between the side faces of the steps or pallets so that the support structure does not exceed the lateral dimensions of the steps or pallets. By this measure, the support structure does not interfere with the supporting structures for the steps or pallets as e.g. the support rails and wheels and so on. Further the support structure does not interfere with the drive elements, e.g. endless chains or belts, which are usually located in the area of the wheels on both sides of the pallets or tracks.

The support structure is preferably mounted to the people mover's frame at mounting points and the sensing means is preferably provided in connection with said mounting points. This measure has the advantage that any load impact along the complete length of the support structure (which preferably extends along the complete length of the conveyor track) can easily be detected by the sensing means arranged in connection with few mounting points of the support structure on the people mover's frame. Of course, it is also possible to arrange the sensing means within the support structure, such that any load impact on load bearing parts of the support structure is transferred to sensing points of the sensing means.

With respect to the use of rods as support structure it can be further carried out that these rods can easily be placed along the complete length of the conveyor track also in case of escalators which have a bent conveyor track in the upper and lower ends where the escalator changes the direction from the sloped area into the horizontal end areas.

A very lightweight but reliable and rigid structure is obtained if the support structure is supported on cross beams of the people mover's frame and the mounting point is provided at the connection between the support structure and the cross beams. Via this measure further the sensing means can be located in the area of the mounting points which are in a lateral distance from the typical support and drive structures of the so people mover. Accordingly, this kind of support structure and sensing means in the vicinity of the mounting points can be easily installed and serviced.

Preferably, the mounting points are located at the connection of the support structure and angle brackets which extend, preferably vertically, between the cross beams of the people mover's frame and the support structure. This solution makes the mounting point easily accessible and leads to a simple and lightweight construction for the support structure in the people mover's frame.

Preferably, the sensing means comprises at least one optical fiber which is pressed at sensing points between at least two pressure surfaces. Between these pressure surfaces at least a part of the load impact of the support structures is applied. A detection means is connected to the optical fiber which is configured to measure the optical properties of the fiber or changes of these properties dependent on the deformation or displacement caused by the pressure on the pressure surfaces. This solution has the advantage that the sensing means is insensible against dirt and one optical fiber may be provided to provide all necessary sensing points for the support structure.

In this connection, the optical fiber sensing points could for example be provided on all or nearly all mountings of the support structure to detect any load applied to the support structure. The detection means is able to sense an undue pressure on the optical fiber or deformation caused by a pressure applied to the optical fiber. With this arrangement, the monitoring of the whole travel length of an escalator or travelator is easily possible. The installation is easy as no difficult adjustments are required. No electrical wiring has to be provided which is always a little bit problematic in case of metal people mover's frame which is accessible to the persons using the people mover. No switches and mechanical components are required for the sensing means and no maintenance of the sensing means is necessary. Furthermore, the optical fiber is not susceptible to moisture, weather conditions or changing temperatures. Furthermore, the optical fiber is insensitive to corrosion, vibrations or electromagnetic fields. The detection means can be located in a safe environment at one end of the people mover, e.g. in the vicinity of the control panel of the people mover.

Furthermore, it has to be considered that optical fibers are often already used for skirt board monitoring so that the addition of the optical step or pallet fall through-protection and break recognition is easily to add to such types of escalators or travelators.

In this connection it is preferable if the sensing points are located in connection with the mounting points. The sensing points could for example be located where support structure is connected to angle brackets which again are connected to the people mover's frame, particularly to the cross beams of the people mover's frame.

Preferably at the sensing points the fiber is embedded in a resilient holding fixture, comprising a resilient seating layer which is made from e.g. plastics or rubber. Preferably this resilient seating layer is sandwiched between pressure plates which form pressure surfaces to which the load on the support structure is at least partly applied. By this measure it is ensured that the optical fiber is not damaged in the area of the pressure surfaces of the sensing points.

As it has already been mentioned above, the shorter distance between the lower end of the steps or pallets running in the conveyor track and the upper side of the support structure is preferably between 1 and 30 mm, most preferably between 2 and 15 mm and particularly between 2 and 10 mm. This distance ensures no interaction of the support structure with the lower edge of the steps or pallets during normal operation but minimizes the falling distance of a step or pallet in case of breakage. This again improves the safety for the passengers.

The sensing means could also be provided by other means than the above-mentioned optical fiber, namely by piezoelectric elements, any kind of electromechanical or electromagnetic transducers, per se known load measuring devices or any other optical devices which use an optical beam for measuring a load or a deflection caused by load.

Preferably, the signal output of the sensing means is connected to a signal transmission means for transmitting the load signal to a remote monitoring site. In this case, the load signal can be evaluated in the remote monitoring site and it can be decided there which action is to be taken. Furthermore, if the output of the sensing means is also connected to the control unit it is preferable that the control unit immediately stops the people mover and a signal is transmitted to the remote monitoring site that the people mover immediately needs servicing.

The inventive content of the present invention may also consist of several separate inventions, especially if the invention is considered in the light of explicit or implicit sub-tasks or in respect of advantages or sets of advantages achieved. In this case, some of the attributes contained in the claims below may be superfluous from the point of view of separate inventive concepts. Within the framework of the basic concept of the invention, features of different embodiments of the invention can be applied in conjunction with other embodiments.

Of course, the number of sensing points, sensing means and mountings is not essential for the invention.

The invention is now described by means of examples in connection with the appended drawings.

Figure 2:
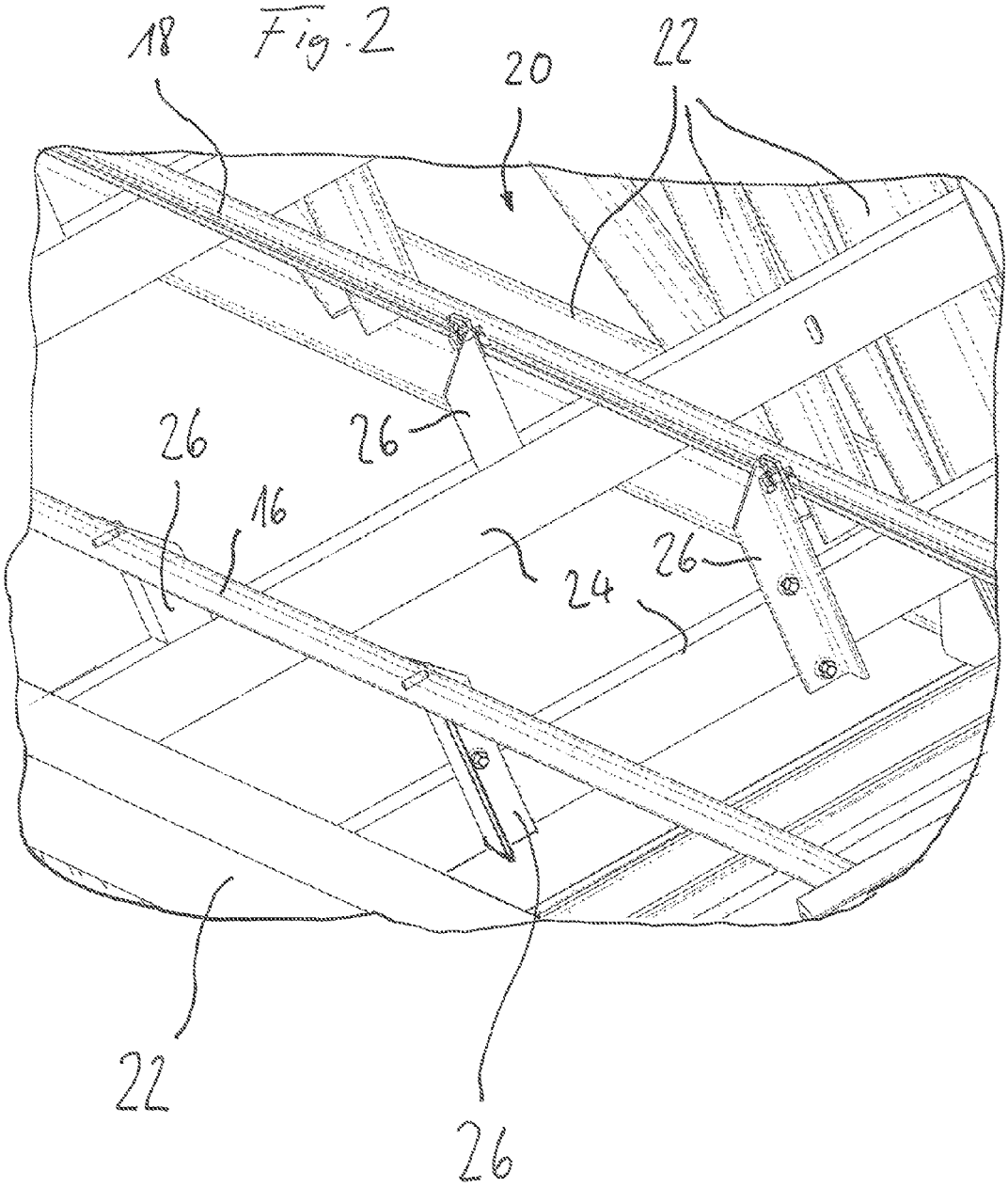
Figure 3:
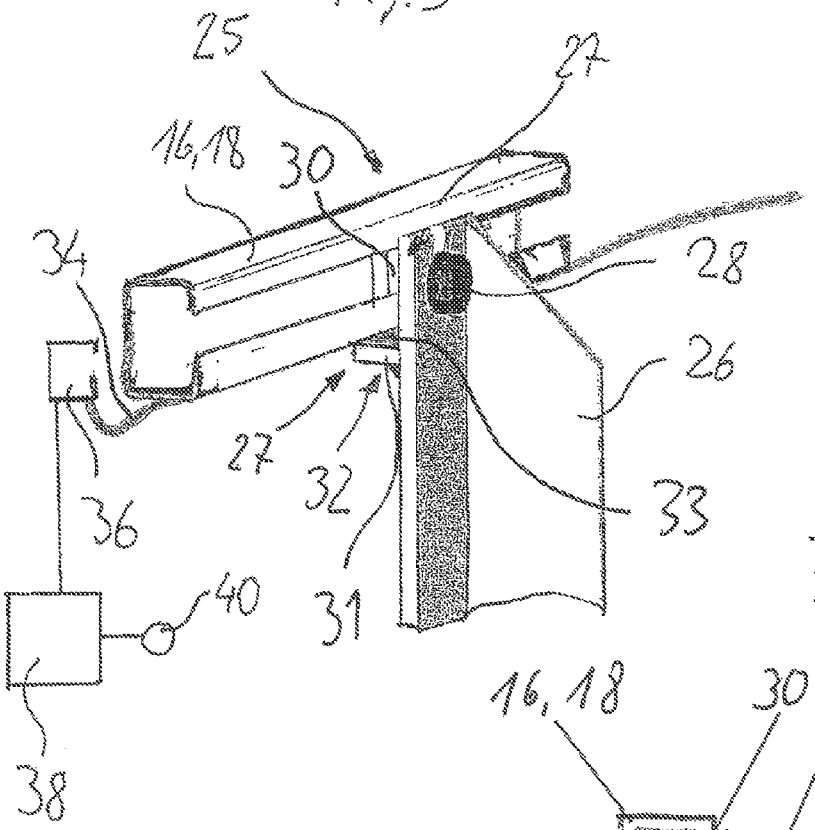
Figure 4:
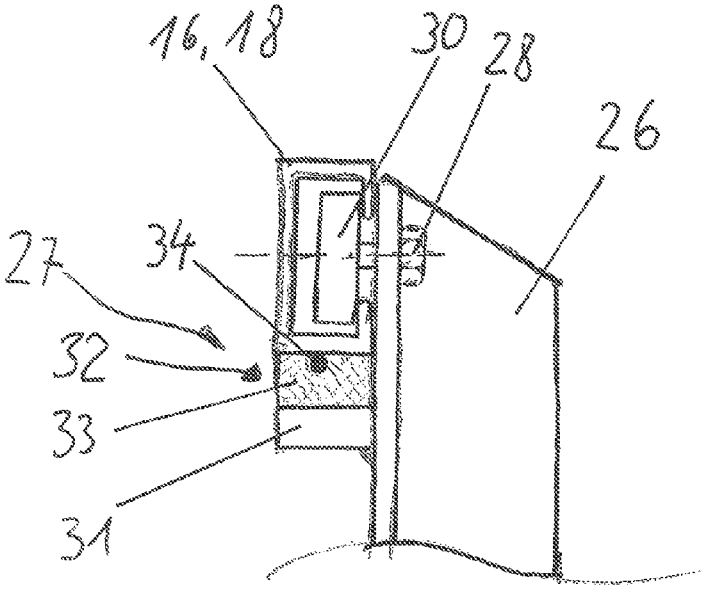
Figure 5:
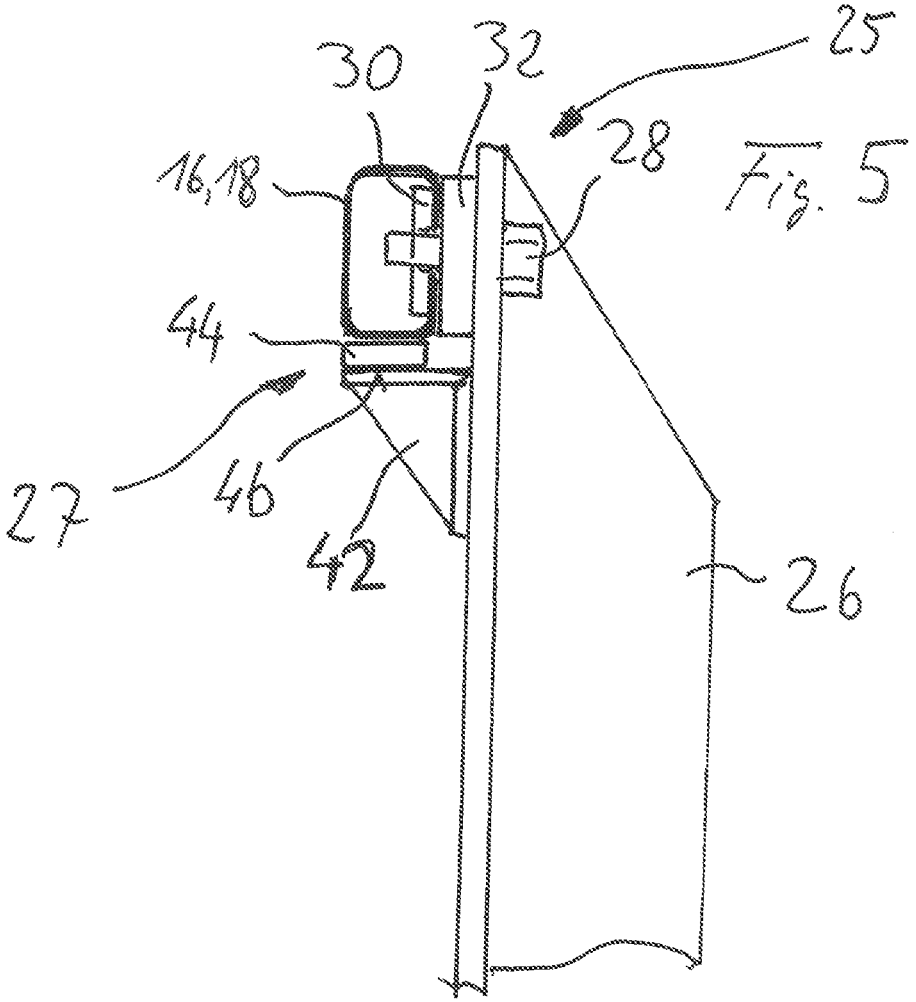

FIG. 1 shows a schematic perspective illustration of the steps of an escalator with two spaced apart rods as support structure, FIG. 2 shows a perspective view of the fixing of the support structure of FIG. 1 to the people mover's frame, FIG. 3 shows a detail of the mounting between a rod and an angular bracket with an optical sensing fiber, FIG. 4 shows a side view of the mounting of FIG. 3, FIG. 5 shows a detail of a second alternative for providing the sensing means in connection with the mounting of the rod to an angular bracket under the use of a piezoelectric element or micro-switch.

FIG. 1 shows very schematically the steps 10 of an escalator which are supported on wheels 12 running in support rails of the escalator (not shown). The steps 10 further comprise connection elements 14 which are connected to an endless drive chain of the escalator whereby the drive chains and these connections 14 are provided on both sides of the steps 10 (not shown). Two spaced apart rods 16, 18 are extending parallel in the running direction below the steps 10 in the conveyor track of the escalator. These rods 16, 18 extend along the complete conveyor track where the steps are available for the passengers to use. The spaced apart rods 16, 18 form a support structure which prevents a step 10 from falling into the escalator when broken. Accordingly, this support structure consisting of the parallel spaced apart rods 16, 18 essentially improves the safety of the escalator. It shall be clear that the same structure can also be used in connection with the pallets of a travelator which is running horizontally or in a slight slope. Instead of parallel rods also another structure can be used, e.g. any kind of scaffold or grate.

FIG. 2 shows how the parallel rods 16, 18 are connected to a frame 20 of the escalator. The frame 20 comprises large support beams 22 which are connected by cross beams 24 extending perpendicular to the moving direction of the steps.

It shall be clear that the escalator frame 20 can also be designed differently. Thus, the cross beams 24 may extend in other directions than perpendicular to the moving direction. Essential is the fact that the cross beams connects the both sides of the escalator frame. The rods 16, 18 of the support structure are fixed to the cross beams 24 via angular brackets 26. These angular brackets 26 preferably extend vertically and allow the adjustment and fixing of the rods above the cross beams 24 in a desired distance below the lower edge of the steps 10 in the conveyor track. This distance is preferably between 1 and 30 mm, preferably between 2 and 15 or 2 and 10 mm.

The connection of the angular brackets 26 and the rods 16, 18 is shown in more detail in FIGS. 3 and 4.

FIGS. 3 and 4 show that each rod 16, 18 is made of a hollow C-profile which is fixed with its open side at mounting points 25 to the angular brackets 26 via a bolt 28 and a thread plate 30 (see FIG. 4).

Between the rod and the angular bracket 26 a resilient holding fixture 32 for an optical fiber 34 is provided to form a sensing point 27. In the embodiment of FIGS. 3 and 4 the optical fiber 34 which runs advantageously in or under the hollow C-profile of the rods 16, 18 is embedded in a resilient holding fixture 32, which is formed by a horizontal mounting plate 31 mounted (e.g. welded) to the angular bracket 26, on which mounting plate a resilient layer 33 is provided. The optical fiber 34 is embedded in the resilient layer 33. The rods 16 18 are supported on the resilient layer 33. If a pressure is applied to the upper side of the rods 16, 18 this pressure is transferred to their lower side which is supported on the resilient layer 33 and the mounting plate 31. Thus any pressure applied to the rods 16, 18 e.g. because of a broken step leads to an increased pressure in the resilient seating layer 33 and accordingly to higher pressure on the optical fiber 43. Upon this higher pressure the optical fiber 34 changes its optical characteristics based on that pressure or based on a deformation via this pressure. This change of the optical properties is measured by a detection means 36 to which the optical fiber 34 is connected. The output of the detection means 36 is connected to the control unit 38 of the escalator. The control unit 38 is further connected to a wire-based or wireless transmission means 40 which outputs the output signal of the detection means 36 or a signal depending on that output signal to a remote location, for example to a remote maintenance location of the escalator company or of a company monitoring the operation of the escalator. Via this solution, breaks of the steps of the escalator can easily be monitored and corresponding actions can be initiated by the control unit 38, as e.g. an immediate stop of the escalator. But also a break of a step 12 might lead to minor drop of the step on the support structure which again might lead to a slight load increase on the support structure which is located only one or few millimeters beneath the lower edge of the steps in the conveyor track. This increase can thus easily be detected by the sensing means and forwarded to a maintenance site to initiate immediate service to the escalator.

FIG. 5 shows a second embodiment of a sensing means in connection with the mechanical arrangement of FIG. 3. Identical or functional identical parts are provided with the same reference numbers. In this arrangement, an angle profile 42 is mounted (e.g. welded) to the angular bracket 26 below the rods 16, 18 and a piezoelectric element 44 or micro-switch is provided between an upper horizontal surface 46 of the angular profile 42 and the lower side of the rods 16, 18. If any load is applied on the upper side of the rods 16, 18, this load is forwarded to the micro-switch or piezoelectric element 44 giving an electric signal for the control unit and possibly also to a remote monitoring location.

Accordingly, also this embodiment easily detects a break of the pallet or a slight sag of the steps because of minor damages, e.g. a break of a bearing or wheel.

The invention has following advantages:

The detection of a step or pallet break is possible over the entire traveling length of the people mover.

If fiber optical components are used, no switches and mechanical components are necessary for sensing the break of a step or pallet. The arrangement is resistant against vibrations, oil, humidity and dust. Furthermore, the invention can be provided with a minor effort of installation and maintenance.

It is apparent for the skilled person that the above-mentioned embodiments are not limited to the illustrated components. Accordingly, the profile of the rods as well as the profile of the angular bracket 26 may be different from that shown in the figures. Furthermore, the connection of the rods to the angular bracket can be performed by different means than a bolt 28 and a thread plate 30. The thickness of the resilient seating layer 33 may deviate essentially from that shown in the figures. The resilient seating layer 33 may be built from any kind of plastics, foam or rubber or textiles.

It shall be further clarified that the other functional components of the escalator are not shown for clarity reasons. These other functional components of the elevator are not affected by the present invention.

The invention can be applied and varied within the scope of the appended patent claims.

The invention claimed is:

1. A people mover comprising:

support rails;

at least one drive element driven by a drive machine;

steps or pallets supported via wheels on the support rails, which steps or pallets are connected to the at least one drive element, whereby the steps or pallets are running in an upper conveyor track of the people mover in a conveying direction and in a lower return track in the opposite return direction;

a support structure provided a short distance below the steps or pallets running in the upper conveyor track, the support structure being located between the upper conveyor track and the lower return track such that the steps or pallets encircle the support structure; and at least one sensor configured to output a load signal dependent on a load applied to the support structure.

2. The people mover according to claim 1, wherein the people mover further comprises a controller which is connected to a signal output of the sensor.

3. The people mover according to claim 2, wherein the controller is configured to stop the people mover dependent on the signal obtained from the sensor.

4. The people mover according to claim 1, which is a travelator or an escalator.

5. The people mover according to claim 1, wherein the support structure comprises parallel spaced apart rods extending in the conveying direction of the steps or pallets.

6. The people mover according to claim 1, wherein the support structure is located between side faces of the steps or pallets.

7. The people mover according to claim 1, further comprising a frame, wherein the support structure is mounted to the frame at mounting points, and wherein the sensor is provided in connection with the mounting points.

8. The people mover according to claim 7, wherein the support structure is supported on cross beams of the frame and the mounting points are provided between the support structure and the cross beams.

9. The people mover according to claim 8, further comprising angle brackets connecting the support structure to the cross beams, wherein the mounting points are located at the connections of the support structure and the angle brackets, which extend between the cross beams and the support structure.

10. The people mover according to claim 1, wherein the sensor comprises:

at least one optical fiber which is provided at sensing points between the support structure and a mounting; and a detector connected to the optical fiber which is configured to measure the optical properties of the fiber or changes thereof.

11. The people mover according to claim 7, wherein sensing points are located in connection with the mounting points.

12. The people mover according to claim 10, wherein at the sensing points resilient holding fixtures are provided, and wherein the fiber is embedded in a resilient seating layer between the support structure and a mounting plate.

13. The people mover according to claim 1, wherein the short distance is between 1 mm and 30 mm.

14. The people mover according to claim 1, wherein the sensor comprises piezoelectric elements, provided in connection with mounting points of the support structure.

15. The people mover according to claim 1, wherein the signal output of the sensor is connected with a signal transmitter for transmitting the signal to a remote monitoring site.

16. The people mover according to claim 1, wherein the short distance is between 2 mm and 15 mm.

17. The people mover according to claim 2, which is a travelator or an escalator.

18. The people mover according to claim 3, which is a travelator or an escalator.

19. The people mover according to claim 2, wherein the support structure comprises parallel spaced apart rods extending in the conveying direction of the steps or pallets.

20. The people mover according to claim 3, wherein the support structure comprises parallel spaced apart rods extending in the conveying direction of the steps or pallets.

* * * * *